US010066516B2

(12) United States Patent
Eisenhardt et al.

(10) Patent No.: US 10,066,516 B2
(45) Date of Patent: Sep. 4, 2018

(54) BUCKET TAPPET AND METHOD FOR PRODUCING SAME

(71) Applicant: Schaeffler Technologies AG & Co. KG, Herzogenaurach (DE)

(72) Inventors: Gunter Eisenhardt, Hagenbuchach (DE); Manfred Stratz, Leesten (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 118 days.

(21) Appl. No.: 15/312,204

(22) PCT Filed: Jun. 16, 2015

(86) PCT No.: PCT/DE2015/200370

§ 371 (c)(1),
(2) Date: Nov. 18, 2016

(87) PCT Pub. No.: WO2016/029910

PCT Pub. Date: Mar. 3, 2016

(65) Prior Publication Data

US 2017/0081985 A1 Mar. 23, 2017

(30) Foreign Application Priority Data

Aug. 26, 2014 (DE) ..... 10 2014 216 961

(51) Int. Cl.
*F01L 1/16* (2006.01)
*F01L 1/14* (2006.01)
*F01L 1/46* (2006.01)

(52) U.S. Cl.
CPC ..... *F01L 1/16* (2013.01); *F01L 1/143* (2013.01); *F01L 1/146* (2013.01); *F01L 1/46* (2013.01); *F01L 2103/00* (2013.01)

(58) Field of Classification Search
CPC ..... F01L 1/14; F01L 1/143; F01L 1/16; F01L 1/46; F01L 2103/00; F01L 2103/01
(Continued)

(56) References Cited

U.S. PATENT DOCUMENTS

2013/0199331 A1* 8/2013 Himsel ..... C23C 14/0605 74/569

FOREIGN PATENT DOCUMENTS

DE 102006036839 2/2008
DE 102010032254 1/2012
(Continued)

*Primary Examiner* — Jorge Leon, Jr.
(74) *Attorney, Agent, or Firm* — Volpe and Koenig, P.C.

(57) ABSTRACT

The invention relates to a bucket tappet for an internal combustion engine, having a tappet housing with a hollow cylindrical bucket skirt and a bucket base which closes one side of the bucket skirt and on which the bucket skirt is formed by cold forming a steel blank without cutting. The outside of the bucket base is used as a contact surface for an internal combustion engine cam which transfer a stroke movement to the bucket tappet, and the outside of the bucket skirt is used as a contact surface for an internal combustion engine guide bore which supports the bucket tappet in the stroke direction. The aim of the invention is to develop a bucket tappet of the aforementioned type and a method for producing same with respect to reduced production costs. This is achieved in that the unmachined and uncoated cam contact surface of the bucket base is machined using a brushing tool and no additional mechanical machining of the cam contact surface is carried out.

10 Claims, 1 Drawing Sheet

(58) Field of Classification Search
USPC ..... 123/90.51
See application file for complete search history.

(56) References Cited

FOREIGN PATENT DOCUMENTS

| | | |
|---|---|---|
| DE | 102011076410 | 11/2012 |
| DE | 102011120591 | 6/2013 |
| EP | 1987921 | 11/2008 |

* cited by examiner

BUCKET TAPPET AND METHOD FOR PRODUCING SAME

BACKGROUND

The invention relates to a bucket tappet for an internal combustion engine having a tappet housing with a hollow cylindrical bucket skirt and a bucket base which closes the bucket skirt on one side and on which the bucket skirt is formed by cold forming a steel blank without cutting, wherein the outside of the bucket base is used as a contact surface for a cam of the internal combustion engine for transferring a stroke movement to the bucket tappet and for which the outside of the bucket skirt is used as a contact surface for a guide hole of the internal combustion engine supporting the bucket tappet in the stroke direction.

Such bucket tappets are used in gas exchange valve trains of internal combustion engines to transfer the cam lifting of a cam to a camshaft in an opening movement of the associated gas exchange valve. There is also the ability to use the bucket tappet as a tapping element for the cams of a fuel injection pump to transfer the lifting of the pump cam to the piston of the injection pump. Each case involves a mechanically strongly loaded component that must sufficiently withstand, on one hand, the Hertzian pressure forces occurring in the cam contact area with low wear and is to be sufficiently supported, on the other hand, in a guide hole with low wear and low noise.

For a long time, bucket tappets that are suitable for large-scale production have already used steel tappet housings that are cold formed without cutting and are then heat treated for increasing the hardness of all contact surfaces. The final contour of the tappet housing generated by cutting is typically produced in a grinding process in which the outside of the bucket skirt, that is, the guide contact surface of the bucket tappet, is finished to the tolerance dimension required for the longitudinal guide of the bucket tappet and the outside of the bucket base, that is, the cam contact surface, is finished to the surface geometry required for the cam contact while reducing the surface roughness.

From DE 10 2011 076 410 A1, a bucket tappet and a method for its production are known. The metal tappet housing is produced by a cold forming process without cutting, then heat-treated, and finally the outside of the bucket skirt is ground to the required dimension. The surface geometry required for the cam contact is achieved by a polishing and/or lapping process. Then a diamond-like carbon (DLC) coating is applied that is then reprocessed mechanically by brushing. The brushing process is constructed so that each section of the surface to be processed is processed uniformly with respect to processing intensity and also the relative movement between the bucket tappet and the brushing tool, in particular, without preferring any certain direction, so that an isotropic, wear-optimized, and friction-optimized surface structure is produced.

SUMMARY

In light of this background, the present invention is based on the objective of improving a bucket tappet of the type specified above and a method for its production each with respect to reduced production costs.

The solution of this objective is given by a bucket tappet and by a method for the production of this bucket tappet according to the features of the independent claims. Advantageous improvements are defined in the respectively allocated dependent claims.

The invention consequently initially relates to a bucket tappet for an internal combustion engine, having a tappet housing with a hollow-cylindrical bucket skirt and a bucket base that closes the bucket skirt on one side and on which the bucket skirt is formed by the cold forming of a steel blank without cutting, wherein the outside of the bucket base is used as a contact surface for a cam of the internal combustion engine transferring a stroke movement to the bucket tappet and in which the outside of the bucket skirt is used as a contact surface for a guide hole of the internal combustion engine supporting the bucket tappet in the stroke direction. To achieve the objective related to a device, for this bucket tappet, the unmachined and uncoated cam contact surface of the bucket base is processed by a brushing tool in a cutting process.

In contrast to the prior art mentioned above, the cam contact surface of the bucket base is not fine-machined by a polishing and/or lapping process, but instead the entire mechanical processing of the cam contact surface of the bucket base is performed exclusively by brushing, so that the cam contact surface has an isotropic structure and the bucket tappet processed mechanically in this way, whose bucket skirt is ground to size, can be already used in this form.

Optionally, the bucket tappet can be heat-treated after the cold forming for the purpose of increasing the hardness, wherein the brushing of the cam contact surface of the bucket base can be performed before or after the heat treatment.

Another measure for reducing wear can consist in that the cam contact surface of the bucket base has a coating that is preferably formed as a DLC coating.

The initially mentioned objective is also achieved by a method for producing a bucket tappet for an internal combustion engine of the type mentioned above. Consequently, the invention also relates to a method for producing a bucket tappet for an internal combustion engine that has a bucket tappet, a tappet housing with a hollow-cylindrical bucket skirt, and a bucket base that closes the bucket skirt on one side and on which the bucket skirt is formed by cold forming of a steel blank without cutting, wherein the outside of the bucket base is used as a contact surface for a cam of the internal combustion engine transferring a stroke movement to the bucket tappet and in which the outside of the bucket skirt is used as a contact surface for a guide hole of the internal combustion engine supporting the bucket tappet in the stroke direction, wherein the method has the following steps:

a) Deep drawing of the tappet housing from a tailored blank, b) Brushing of the unmachined and uncoated cam contact surface.

The brushing takes place here such that an isotropic surface structure is created.

The method can also have the following step:

aa) Heat treatment of the bucket tappet for increasing the hardness before the brushing of the cam contact surface.

For further wear reduction, the method can have the additional step:

d) After the brushing, application of a coating on the cam contact surface, for example, a DLC coating.

Through use of the described method such that the cam contact surface of the bucket base has a desired and significant improvement of the surface roughness without greatly changing the surface topography generated while rolling the sheet metal for the steel blank. This special topography has a positive effect on reducing the friction moment between the cam and the tappet. Because the polishing and/or lapping of the cam contact surface provided according to DE 10

2011 076 410 A1 is eliminated before the application of the DLC coating and is replaced by the brushing of the unmachined and uncoated cam contact surface of the bucket base, while no other brushing is performed after the application of the DLC coating, the processing time of the bucket tappet is shortened and the production process is simplified, which leads to reduced production costs.

The invention is indeed especially advantageous with respect to the production of a bucket tappet for an internal combustion engine, but cam followers or rocker arms in reciprocating piston machines, or also gear or roller bearing components, especially bearing rings and roller bodies, for example, balls, needles, cylinder rollers, or tapered rollers, can also be formed and produced according to the invention. Steel is preferably used as the base material for the machine element to be coated.

BRIEF DESCRIPTION OF THE DRAWINGS

The invention will be explained further below with reference to an embodiment shown in the drawings. Shown in the drawings are.

DETAILED DESCRIPTION OF THE PREFERRED EMBODIMENTS

Figure 1:
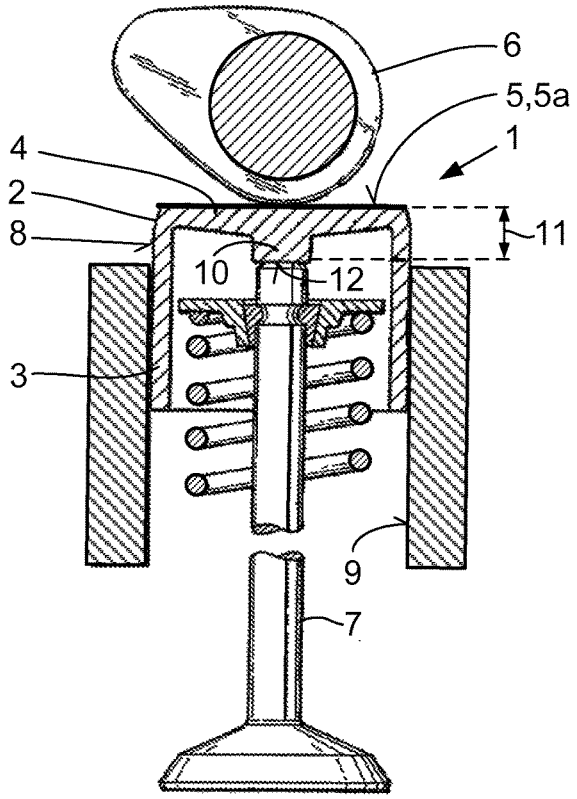
FIG. 1 a gas exchange valve train with a mechanical bucket tappet in longitudinal section, and FIG. 2 an illustration of the brushing process.

FIG. 1 shows a gas exchange valve train of an internal combustion engine formed as a bucket tappet drive with mechanical valve lash compensation. The mechanical bucket tappet 1 is made exclusively from a bucket-shaped tappet housing 2, which is produced in one piece by cold forming without cutting of a steel blank and here by deep drawing of a tailored blank. The tappet housing 2 is assembled from a hollow cylindrical bucket skirt 3 and a bucket base 4 on the axial end side on which the bucket skirt 3 is formed and which closes the bucket skirt 3 on one side. The axial outside of the bucket base 4 is used as a contact surface 5 for a cam 6, whose lifting is transferred from the bucket tappet 1 into an opening movement of the gas exchange valve 7 applying a spring force in the closing direction. The radial outside of the bucket skirt 3 is used as a contact surface 8 for a hollow cylindrical guide hole 9 of the internal combustion engine supporting the bucket tappet 1 in the stroke direction.

The axial inside of the bucket base 4 is provided with a bump 10 that extends in the axial direction of the gas exchange valve 7 and contacts the shaft of the gas exchange valve 7 on the end side. The valve lash setting is realized by assigning a bucket tappet 1 to an axial height 11 of the bump 10 that is suitable for the desired valve lash to be set, wherein the bucket tappet 1 is selected from a group assortment with bumps 10 of different heights and then installed. Depending on the application, a cut, finely machined, in particular, ground end surface 12 of the bump 10 can be provided.

The deep drawn and then, for the purpose of increasing the hardness, heat-treated tappet housing 2 is machined with cutting on its radial outside only on the outside of the bucket skirt 3, that is, in the area of the contact surface 8, and ground. This guarantees that the required dimensional and shape tolerances of the bucket skirt 3 are within their desired range in the guide hole 9. In contrast, the axial outside of the bucket base 4, that is, the cam contact surface 5, is only brushed and has an isotropic surface structure that differs only slightly from the surface structure and surface geometry generated in the deep drawing process and during the heat treatment of the tappet housing 2.

Figure 2:
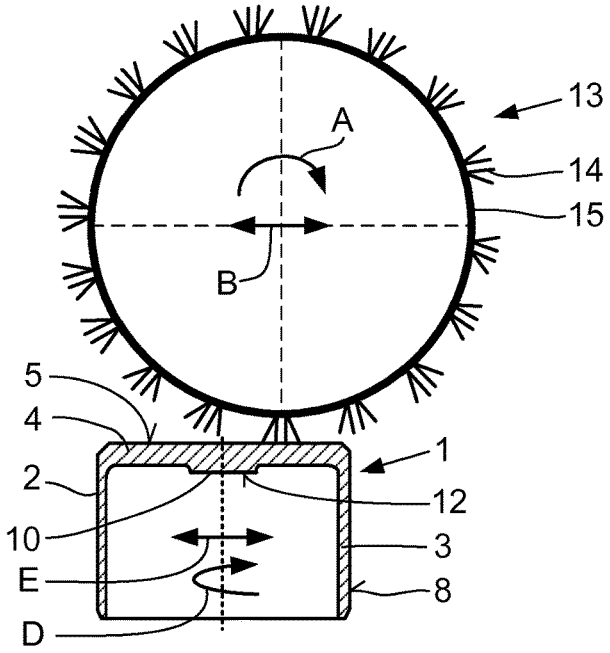

FIG. 2 shows the machining of the bucket tappet 1 by brushing. As a tool, a roller brush 13 rotating in the direction of arrow A is used, whose roller 15 has particle-coated filaments 14. During the brushing, the roller brush 13 is moved back and forth in the direction of the double arrow B. At the same time, the bucket tappet 1 is set in rotation about its longitudinal axis in accordance with the arrow D. In addition, the bucket tappet 1 can also be moved back and forth in the direction of the double arrow E to obtain the desired isotropic structure of the cam contact surface 5. After the brushing, a DLC coating 5*a* is applied on the cam contact surface 5 in this embodiment. Such coatings are disclosed in DE 10 2011 076 410 A1, so that their contents in this regard are herewith a subject matter of the present disclosure.

Instead of a roller brush 13, a generally known cup brush can also be used whose axis of rotation runs perpendicular to the bucket tappet 1 and whose end face turned toward the cam contact surface has the particle-coated filaments 14.

All of the features specified in the preceding description of figures, in the claims, and in the introduction of the description can be used both individually and also in any combination with each other. The invention is thus not restricted to the described and claimed combinations of features, but instead all combinations of features are to be considered as disclosed.

LIST OF REFERENCE NUMBERS

1 Bucket tappet
2 Tappet housing
3 Bucket skirt
4 Bucket base
5 Cam contact surface
5*a* DLC coating
6 Cam
7 Gas exchange valve
8 Contact surface
9 Guide hole
10 Bump on bucket base
11 Height of bump
12 End face of bump
13 Roller brush
14 Particle-coated filament
15 Roller
A Arrow, rotation of the roller brush
B Arrow, translational movement of the roller brush
D Arrow, translational movement of the bucket tappet
E Arrow, rotation of the bucket tappet

The invention claimed is:

1. A bucket tappet for an internal combustion engine, the bucket tappet comprising:

a tappet housing with a hollow-cylindrical bucket skirt and a bucket base that closes the bucket skirt on one side and on which the bucket skirt is formed by cold forming of a steel blank without cutting, an outside of the bucket base is adapted for use as a contact surface for a cam of the internal combustion engine transferring a stroke movement to the bucket tappet and an outside of the bucket skirt is adapted for use as a contact surface for a guide hole of the internal combustion engine supporting the bucket tappet in a stroke direction, and while the cam contact surface of the bucket base is unmachined and uncoated, the cam contact surface is processed by a brush tool with a cutting process forming a brushed cam contact surface.

2. The bucket tappet according to claim 1, wherein the brushed cam contact surface is processed to have an isotropic structure.

3. The bucket tappet according to claim 1, wherein the bucket tappet is heat-treated after cold forming to increase the hardness.

4. The bucket tappet according to claim 1, wherein the brushed cam contact surface of the bucket base is subsequently provided with a coating.

5. The bucket tappet according to claim 4, wherein the coating is formed as a diamond-like carbon (DLC) coating.

6. A method for producing a bucket tappet for an internal combustion engine that has a bucket tappet, a tappet housing with a hollow-cylindrical bucket skirt, and a bucket base that closes the bucket skirt on one side and on which the bucket skirt is formed by cold forming of a steel blank without cutting, wherein an outside of the bucket base is adapted for use as a contact surface for a cam of the internal combustion engine transferring a stroke movement to the bucket tappet and in which an outside of the bucket skirt is adapted for use as a contact surface for a guide hole of the internal combustion engine supporting the bucket tappet in a stroke direction, the method comprising:

a) deep drawing the tappet housing from a tailored blank to form the bucket skirt extending from the bucket base, and b) brushing the cam contact surface while the cam contact surface is unmachined and uncoated.

7. The method according to claim 6, wherein the brushing is performed such that an isotropic structure is produced.

8. The method according to claim 7, further comprising:

d) after the brushing, applying a coating on the cam contact surface.

9. The method according to claim 8, wherein the coating is a diamond-like carbon (DLC) coating applied on the cam contact surface.

10. The method according to claim 6, further comprising:

aa) heat treating of the bucket tappet to increase a hardness before the brushing of the cam contact surface.

* * * * *